US009611063B2

(12) United States Patent
Gathers

(10) Patent No.: US 9,611,063 B2
(45) Date of Patent: Apr. 4, 2017

(54) FLEX IRRIGATION BASIN

(71) Applicant: Sekuleo Gathers, River Edge, NJ (US)

(72) Inventor: Sekuleo Gathers, River Edge, NJ (US)

( * ) Notice: Subject to any disclaimer, the term of this patent is extended or adjusted under 35 U.S.C. 154(b) by 11 days.

(21) Appl. No.: 14/607,007

(22) Filed: Jan. 27, 2015

(65) Prior Publication Data

US 2016/0214755 A1 Jul. 28, 2016

(51) Int. Cl.

| | |
|---|---|
| ***A47K 1/04*** | (2006.01) |
| ***B65D 1/40*** | (2006.01) |
| ***B65D 53/00*** | (2006.01) |
| ***B65D 43/14*** | (2006.01) |
| ***A61H 35/00*** | (2006.01) |

(52) U.S. Cl.

CPC ..... *B65D 1/40* (2013.01); *A61H 35/00* (2013.01); *B65D 43/14* (2013.01); *B65D 53/00* (2013.01)

(58) Field of Classification Search

CPC ..... A61M 1/00; A61M 3/0225; A61M 3/02; B65D 11/10; B65D 11/18; B65D 1/40; B65D 53/00; B65D 43/14; A61H 35/00

USPC .... 220/676, 571, 484, 601, 661; 4/621, 622, 4/644, 645

See application file for complete search history.

(56) References Cited

U.S. PATENT DOCUMENTS 5,816,433 A * 10/1998 Higgins ..... A45C 11/20 220/503
7,641,835 B2 * 1/2010 Ramsey ..... B65F 1/06 220/495.08
7,785,303 B2 * 8/2010 Tapadiya ..... A61H 35/00 604/317
8,672,179 B2 * 3/2014 Bradley ..... E05D 7/1005 220/254.3
2003/0168461 A1 * 9/2003 Richardson ..... B65F 1/02 220/661
2005/0178770 A1 * 8/2005 Hase ..... B65D 25/005 220/592.2
2008/0029528 A1 * 2/2008 Mireault ..... B65D 43/12 220/810
2010/0006467 A1 * 1/2010 Joseph ..... B65D 1/22 206/508
2011/0220654 A1 * 9/2011 Gray ..... B65F 1/062 220/495.06
2012/0273505 A1 * 11/2012 Bose ..... A45C 5/14 220/592.16

* cited by examiner

*Primary Examiner* — J. Gregory Pickett
*Assistant Examiner* — Niki M Eloshway
(74) *Attorney, Agent, or Firm* — Thomas A. O'Rourke; Bodner & O'Rourke, LLP

(57) ABSTRACT

A basin with opposing hinged doors for providing a hospital-grade basin which can be used as either a traditional, watertight basin or a modified watertight basin that includes half-moon shaped openings disposed in its side walls to allow a patient's limb to rest comfortably while positioned across the basin. The basin with opposing hinged doors defines a tub member that includes at least one side wall with a semicircle opening extending down into it from the top of the wall. For each opening, a correspondingly shaped door is hingedly attached adjacent thereto, enabling it to move between a closed position defining the traditional, watertight basin and an open position defining a modified watertight basin with an opening for part of a limb. Each opening and door employ a locking means suitable to secure the door in place when desired.

8 Claims, 4 Drawing Sheets

FLEX IRRIGATION BASIN

DETAILED DESCRIPTION OF THE INVENTION

Figure 1:
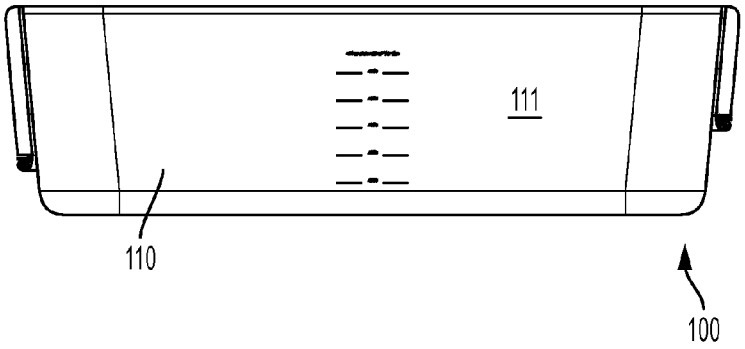
FIG. 1 is a front longitudinal side perspective view of a basin with opposing hinged doors built in accordance with the present invention having its doors in a closed position.

Referring now to the drawings and in particular FIGS. 1, 2, 3, and 4, a basin with opposing hinged doors 100 is shown as a four sided tub member 110 that includes a first side wall 111, a second side wall 112, a large door side wall 113, and a small door side wall 114, each of which extend up from a tub floor 115. In the preferred embodiment, the tub member 110 is defined by a rectangular shape with the first side wall 111 and the second side wall 112 defining its longitudinal sides. It is contemplated, however, that in other embodiments the large door side wall 113 and small door side wall 114 may define the longitudinal sides or the tub member 110 may be defined by an alternate shape suitable for a basin, such as a kidney shape, a round shape, or an oval shape. It is additionally contemplated that the tub member 110 may be constructed in a range of sizes, whether to accommodate different body parts or different size requirements.

In the preferred embodiment, the large door side wall 113 includes a large door frame section 130 and the small door side wall 114 includes a small door frame section 140. The large door frame section 130 outlines a semi-circular shaped large opening extending down from the top of the large door side wall 113 into the body of the large door side wall 113. The large door frame section 130 includes a large mounting frame 131 which defines a frame structure that extends around the border of the large opening that extends into the large door side wall 113, thereby creating a large border surface area 132 having increased thickness relative to the thickness of the large door side wall 113. In the preferred embodiment, the large opening has a diameter of 5.5 inches, resulting in it extending 5.5 inches wide across the large door side wall 113 at the widest point and 2.75 inches into the large door side wall 113 at its deepest point.

Figure 2:
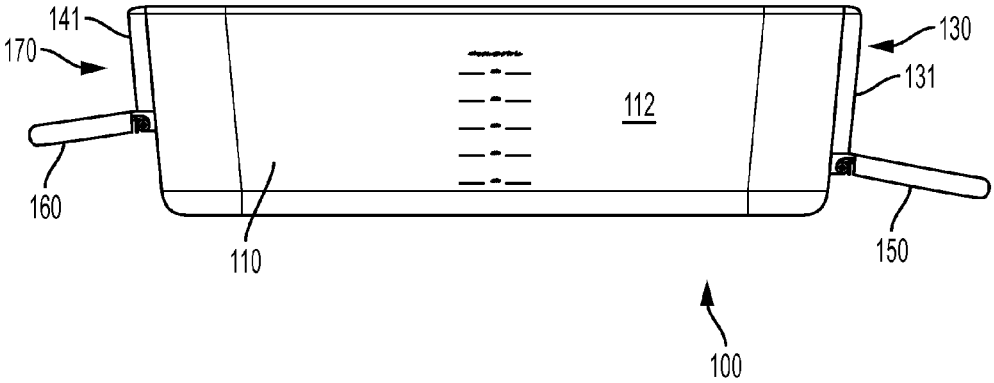
FIG. 2 is a back longitudinal elevational view of a basin with opposing hinged doors built in accordance with the present invention having its doors in an open position.
Figure 3:
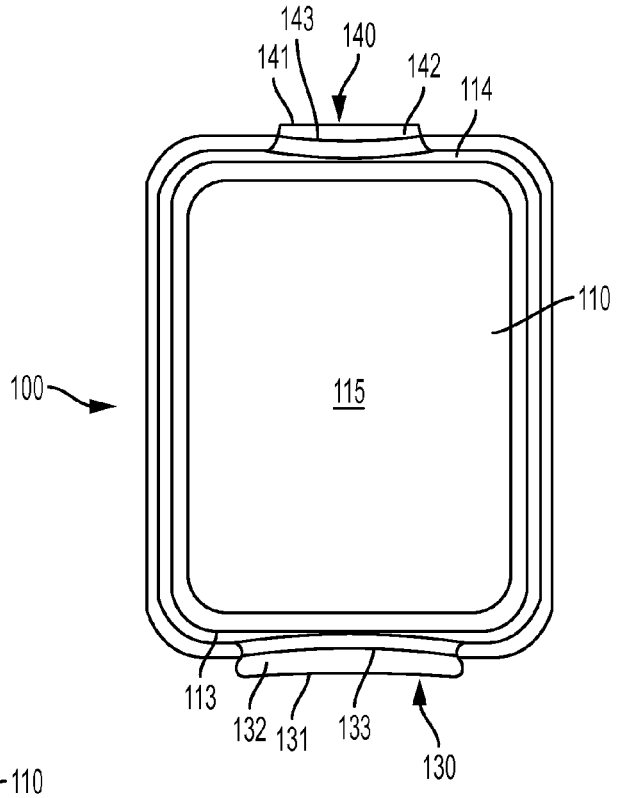
FIG. 3 is a top plan view of the tub member of a basin with opposing hinged doors built in accordance with the present invention.
Figure 4:
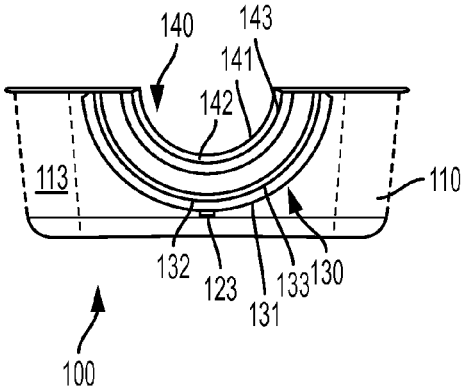
FIG. 4 is a large door side elevational view of the tub member of a basin with opposing hinged doors built in accordance with the present invention.
Figure 5:
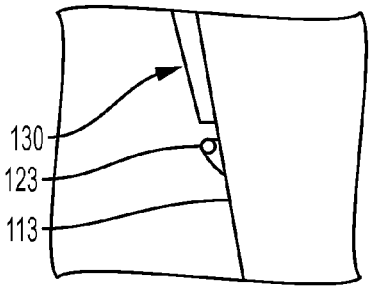
FIG. 5 is a side elevational view of a section of the side wall of the tub member of a basin with opposing hinged doors built in accordance with the present invention.
Figure 6:
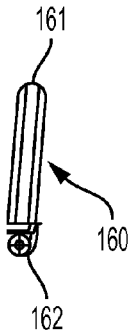
FIG. 6 is a side elevational view of the small door of a basin with opposing hinged doors built in accordance with the present invention.
Figure 8:
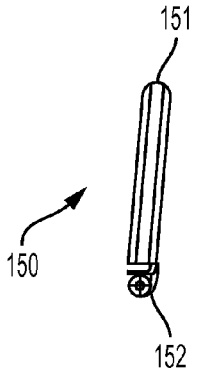
FIG. 8 is a side elevational view of the large door of a basin with opposing hinged doors built in accordance with the present invention.
Figure 7:
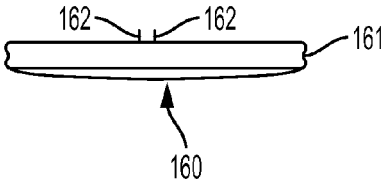
FIG. 7 is a top plan view of the small door of a basin with opposing hinged doors built in accordance with the present invention.
Figure 9:
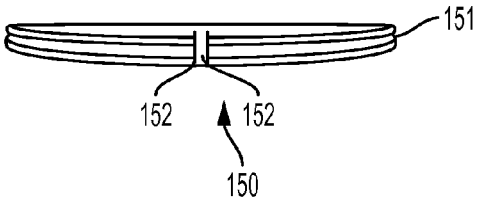
FIG. 9 is a bottom plan view of the large door of a basin with opposing hinged doors built in accordance with the present invention.
Figure 10:
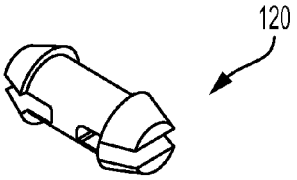
FIG. 10 is a side elevational view of the fastening pin of a basin with opposing hinged doors built in accordance with the present invention.
Figure 11:
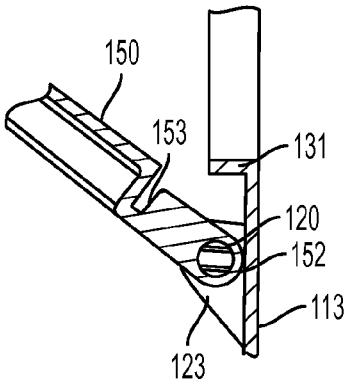
FIG. 11 is a side elevational view of a section of the side wall of the tub member and corresponding door of a basin with opposing hinged doors built in accordance with the present invention with the door in the open position.
Figure 12:
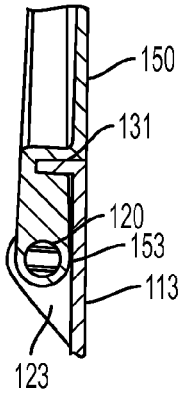
FIG. 12 is a side elevational view of a section of the side wall of the tub member and corresponding door of a basin with opposing hinged doors built in accordance with the present invention with the door in the closed position.

Integral with the large door frame section 130 is a large door member 150 sized to fit into the large mounting frame 131, thereby allowing it to be moved into a closed position in the large door frame section 130, as illustrated by FIG. 1, into an open position relative to the large door frame section 130 as illustrated in FIG. 2, as well as hinged between the closed and open positions. It is contemplated, however, that the large door frame section 130 and corresponding large door member 150 may together be constructed in alternate shapes and different sizes relative to the large door side wall 113.

The small door side wall 114 is structured in a similar manner as the large door side wall 113, with the only substantive difference being that the small door frame section 140 is smaller than the large door frame section 130. Accordingly, the small door frame section 140 outlines a semi-circular shaped small opening extending down from the top of the small door side wall 114 into the body of the small door side wall 114. The small door frame section 140 includes a small mounting frame 141 which defines a frame structure that extends around the border of the small opening that extends into the small door side wall 114, thereby creating a small border surface area 142 having increased thickness relative to the thickness of the small door side wall 114. In the preferred embodiment, the small opening has a diameter of 4 inches, resulting in it extending 4 inches wide across the small door side wall 114 at the widest point and 2 inches into the small door side wall 114 at its deepest point.

Integral with the small door frame section 140 is a small door member 160 sized to fit into the small mounting frame 141, thereby allowing it to be moved into a closed position in the small door frame section 140, as illustrated by FIG. 1, into an open position relative to the small door frame section 140 as illustrated in FIG. 2, as well as hinged between the closed and open positions. It is contemplated, however, that the small door frame section 140 and corresponding small door member 160 may together be constructed in alternate shapes and different sizes relative to the small door side wall 114.

It is contemplated that by including the large door frame section 130 and the small door frame section 140, the tub member 110 provides a modified basin means for collecting debris, water, run-off materials or specimens. Further, by corresponding to the respective large door frame section 130 and the small door frame section 140, the large door member 150 and small door member 160 each provide a door means for selectively opening and closing an entry point in the tub member 110.

Referring now to FIGS. 3, 4, 5, 6, 7, 8, 9, 10, 11 and 12, the large border surface area 132 and small border surface area 142 each include a centrally disposed ridge member 133, 143 running longitudinally through it. The ridge members 133, 143, along with corresponding centrally disposed recesses 151, 161 in large door member 150 and small door member 160, respectively, provide a locking means for securing the large door member 150 and small door member 160 in the large door frame section 130 and small door frame section 140, respectively, when the respective door member is in the closed position. The locking means is operative to allow the large door member 150 to snap into the large door frame section 130 when the large door member 150 is moved to the closed position. In this regard, when the large door member 150 is moved to the closed position, the ridge member 133 frictionally passes along the circumferential surface of the large door member 150 as it moves toward the closed position and engages the recess 151 once the large door member 150 is in the closed position. When secured in the closed position, the large door member 150 is operative to close the large opening outlined by the large door frame section 130 and form a watertight seal.

The locking means operates in essentially the same manner with the small door member 160 and the small door frame section 140. Thus, the small door member 160 snaps into the small door frame section 140 when the small door member 160 is moved to the closed position. When the small door member 160 is moved to the closed position, the ridge member 143 frictionally passes along the circumferential surface of the small door member 160 as it moves toward the closed position and engages the recess 161 once the small door member 160 is in the closed position. As with the large door member, when the small door member 160 is secured in the closed position, it closes the small opening outlined by the small door frame section 140 and forms a watertight seal.

A small door hinge mechanism enables the small door member 160 to attach to the small door side wall 114. The small door hinge mechanism is defined by two hinge attachment arms 162 which extend down from the bottom of the small door member 160, a small wall receiving member (not shown, but identical to the large wall receiving member 123 discussed below) which extends out from the side of the small door side wall 114 underneath the small door frame section 140, and a fastening pin 120. The fastening pin 120 is structured to pass transversely through holes in both the small wall receiving member and the two hinge attachment arms 162 and remain fixed therein, thereby forming a pivot about which the small door member 160 rotates relative to the small door side wall 114.

The large door member 150 and large door side wall 113 are connected through a large door hinge mechanism, which employs the same type of components as the small door hinge mechanism. Accordingly, the large door hinge mechanism is defined by two hinge attachment arms 152 which extend down from the bottom of the large door member 150, a large wall receiving member 123 which extends out from the side of the large door side wall 113 underneath the large door frame section 130, and another fastening pin 120. As with the small door hinge mechanism, the fastening pin 120 is structured to pass transversely through holes in both the large wall receiving slot member 123 and the two hinge attachment arms 152 and remain fixed therein, thereby forming a pivot about which the large door member 150 rotates relative to the small door side wall 113.

In the preferred embodiment, a secondary locking means for securing the large door member 150 and small door member 160 in the large door frame section 130 and small door frame section 140, respectively, when the respective door member is in the closed position is present on each door and defined by identical structures. The second locking means, as illustrated on the large door side wall 113 in FIGS. 11 and 12, includes a locking recess 153 formed in the area between the two hinge attachment arms 152 and the large door member 150 and the abutment formed by large mounting frame 131 as it extends outward from the large door side wall 113. The corresponding locking recess 153 and abutment engage when the large door member 150 is in the closed position relative to the large door frame section 130, thereby providing a supplemental lock for keeping the large door member 150 in place. It is understood that the small door member 160 and small door frame section 140 include identical structures, thereby enabling such a supplemental lock in their operation.

Figure 13:
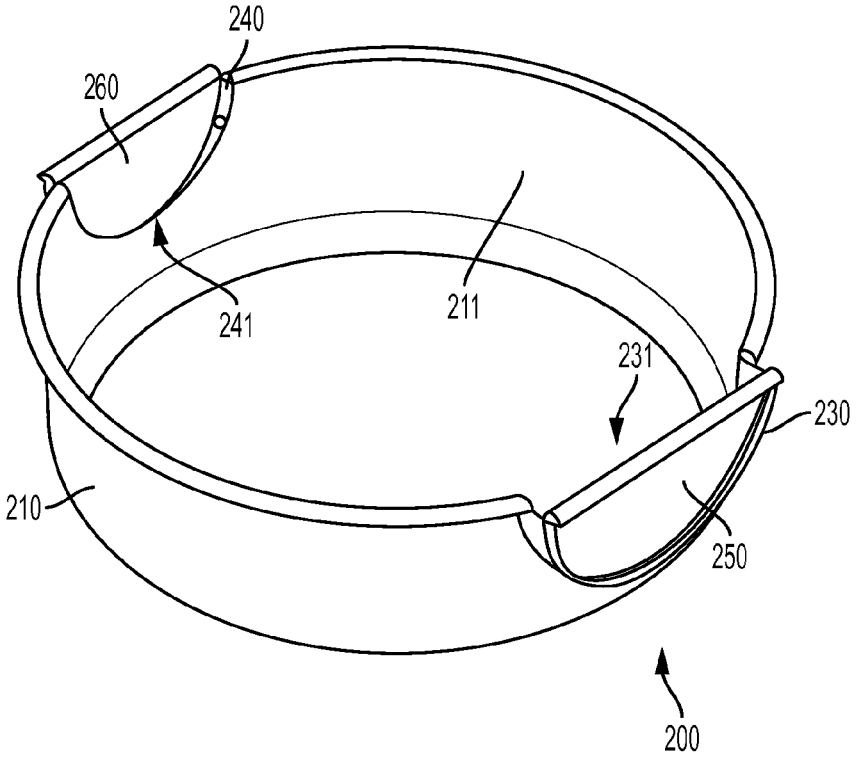
FIG. 13 is a side perspective view of a basin with opposing hinged doors built in accordance with a round embodiment of the present invention having its doors in a closed position.

Referring now to FIG. 13, an alternate embodiment of a basin with opposing hinged doors 200 is shown as a circular tub member 210 with a circumferential side wall 211 that includes a large door frame section 230 surrounding a large opening 231 and a small door frame section 240 surrounding a small opening 241. As with the rectangular embodiment, integral with the large door frame section 230 is a large door member 250 sized to fit into the large opening 231, thereby allowing it to be moved into a closed position in the large door frame section 230 and integral with the small door frame section 240 is a small door member 260 sized to fit into the small opening 241, thereby allowing it to be moved into a closed position in the small door frame section 240. It is contemplated that the large door frame section 230 and large door member 250 and the small door frame section 240 and small door member 260, respectively, are operative to move between an open and closed position in the same manner as described above for the rectangular embodiment.

The present invention has been shown and described herein in what is considered to be the most practical and preferred embodiment. It is recognized, however, that departures may be made therefrom within the scope of the invention and that obvious modifications will occur to a person skilled in the art.

What is claimed is:

1. A transformable basin configured to reversibly convert from a traditional fluid collecting basin into an irrigation basin for irrigating a limb of a patient, said transformable basin comprising:

a tub member comprising: a floor, and a wall configured to extend away from said floor to terminate at a distal periphery; said wall comprising: a first semi-circular shaped opening formed in a first portion of said wall to form a first reduced height portion of said distal periphery, said first semi-circular shaped opening sized to receive a first portion of the patient's limb therein; and a second semi-circular shaped opening formed in a second portion of said wall to form a second reduced height portion of said distal periphery, to be aligned with said first semi-circular shaped opening on an opposite side of said wall, said second semi-circular shaped opening sized to receive a second portion of the patient's limb therein; said tub comprising a first arcuate flange configured to protrude away from said wall at said first semi-circular shaped opening to provide support for the first portion of the patient's limb, and said tub comprising a second arcuate flange configured to protrude away from said wall at said second semi-circular shaped opening to provide support for the second portion of the patient's limb;

a first door pivotally mounted to said wall of said tub member at a position configured for said first door to seal against said first arcuate flange of said first semi-circular shaped opening, and be retained thereat using a friction fit, in a closed position; said first door configured to be downwardly disposed away from first semi-circular shaped opening when pivoted into an open position; and a second door pivotally mounted to said wall of said tub member at a position configured to create a water-tight seal against said second arcuate flange of said second semi-circular shaped opening when in a closed position; and to be downwardly disposed away from said second semi-circular shaped opening when pivoted into an open position.

2. The transformable basin according to claim 1 wherein a radius of said first semi-circular shaped opening is larger than a radius of said second semi-circular shaped opening.

3. The transformable basin according to claim 1 wherein said wall of said tub member comprises four sides that form a rectangular shape.

4. The transformable basin according to claim 1 wherein said wall of said tub member is formed into an oval shape.

5. The transformable basin according to claim 1 wherein said wall of said tub member is funned into a kidney shape.

6. The transformable basin according to claim 1, wherein each of said first and second doors are respectively configured to lay flush with an interior of said wall when in the closed position.

7. The transformable basin according to claim 1, wherein each of said first and second doors comprise a ridge, and each of said first and second arcuate flanges comprise a corresponding recess, with said ridges respectively configured to snap into said corresponding recesses, when the first and second doors are pivoted into the respective closed positions.

8. The transformable basin according to claim 1, further comprising secondary locking means for each of said first and second doors when in the closed position.

* * * * *